United States Patent [19]

Brunetto et al.

[11] Patent Number: 5,016,504

[45] Date of Patent: May 21, 1991

[54] AIR VENT OPENER

[76] Inventors: Thomas Brunetto, 20 Greenwich Ave., Lakehurst, N.J. 08733; George Spector, 233 Broadway, Rm 3815, New York, N.Y. 10007

[21] Appl. No.: 528,606

[22] Filed: May 25, 1990

[51] Int. Cl.[5] ..... B25B 9/00; A47F 13/06

[52] U.S. Cl. ..... 81/488; 294/19.1

[58] Field of Search ..... 81/488, 484; 294/19.1, 294/22, 24

[56] References Cited

U.S. PATENT DOCUMENTS 3,360,291 12/1967 Barrett ..... 294/19.1

3,737,187 6/1973 Pryor ..... 294/19.1

3,866,965 2/1975 Homeier ..... 294/19.1

4,203,332 5/1980 Corsetti ..... 81/484

*Primary Examiner*—Roscoe V. Parker

[57] ABSTRACT

An extension device is provided for opening and closing an air vent lever and consists of upper and lower slots in an enlarged aperture within an enlarged head transversely placed on an elongated handle. The handle is grasped by a user of the device in which the slots can open and close the air vent lever. In a modification the handle can be angularly adjusted and locked in position so that the user can reach an out of the way air vent lever.

4 Claims, 1 Drawing Sheet

AIR VENT OPENER

BACKGROUND OF THE INVENTION

The instant invention relates generally to tools and more specifically it relates to an extension device for opening and closing an air vent lever which provides an assistance to the user of the device in opening and closing the air vent lever.

There are available various conventional tools which do not provide the novel improvements of the invention herein disclosed.

SUMMARY OF THE INVENTION

A primary object of the present invention is to provide an extension device for opening and closing an air vent lever that will overcome the shortcomings of the prior art devices.

Another object is to provide an extension device for opening and closing an air vent lever which will assist a person in extending their reach in opening and closing an air conditioner vent lever and a heat wall air duct vent lever.

An additional object is to provide an extension device for opening and closing an air vent lever in which the handle of the device is angularly adjustable so as to reach out ot the way places having the air vent lever that must be opened and closed.

A further object is to provide an extension device for opening and closing an air vent lever that is simple and easy to use.

A still further object is to provide an extension device for opening and closing an air vent lever that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCIPTION OF THE DRAWING FIGURES

DETAILED DESCRIPTION OF THE PREFERRED EMBODIMENTS

Figure 1:
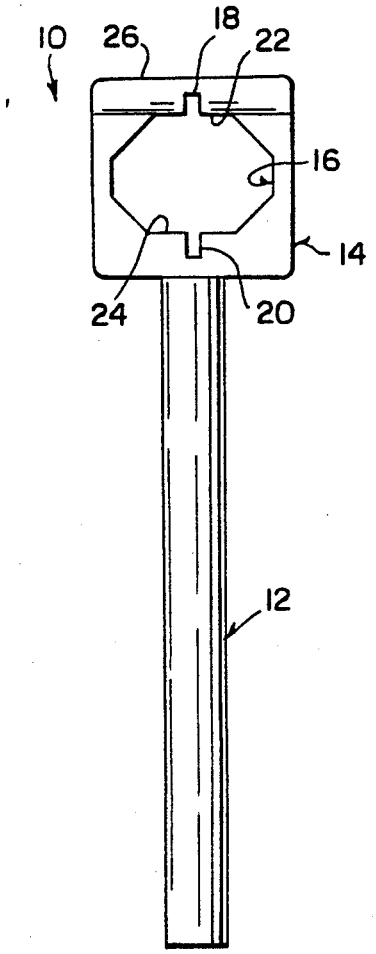
FIG. 1 is a front view of the invention.
Figure 2:
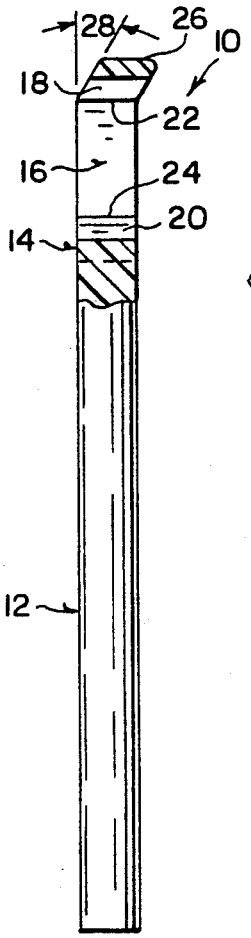
FIG. 2 is a side view thereof with parts broken away in section.

Turning now descriptively to the drawings, in which similar reference characters denote similar elements throughout the several views, FIGS. 1 and 2 illustrate an extension device 10 for opening and closing an air vent lever (not shown). The extension device 10 consists of an elongated handle 12 to be grasped at one end thereof by a user of the extension device 10. An enlarged head 14 is at other end of the elongated handle 14, whereby the enlarged head 14 has an enlarged aperture 16 therethrough transversely positioned to the elongated handle 12.

The enlarged head 14 further has a pair of slots 18 and 20 for opening and closing the air vent lever. One slot 18 is formed extending from an upper portion 22 of the enlarged aperture 16, while the other slot 20 is formed extending from a lower portion 24 of the enlarged aperture 16. Each of the slots 18 and 20 can push and pull the air vent lever to open and close an air vent depending how the air vent lever is positioned on the air vent.

The upper portion 26 of the enlarged head 14 is angularly positioned at 28, between at least a thirty to forty five degree pitch, with respect to the elongated handle 12. The upper slot 18 will be in a better position to push and pull the air vent lever.

Figure 3:
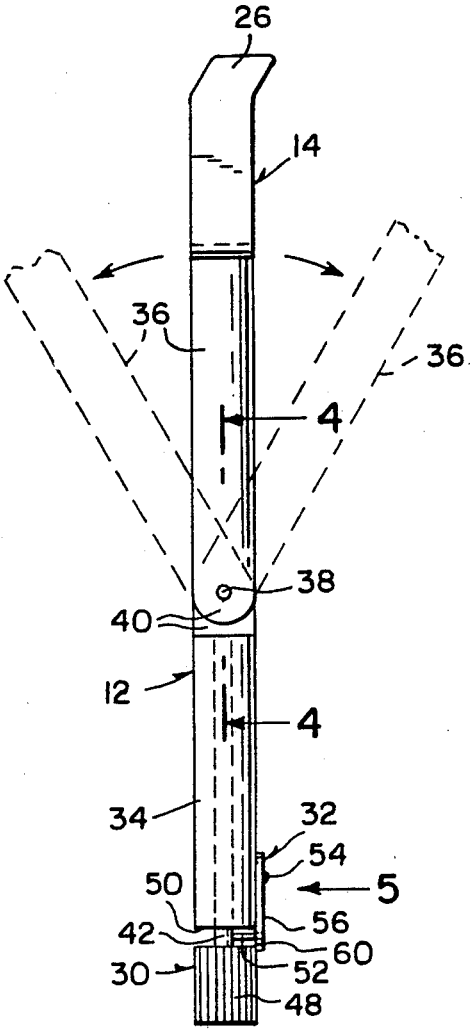
FIG. 3 is a side view of a modification in which the elongated handle is angularly adjustable.
Figure 4:
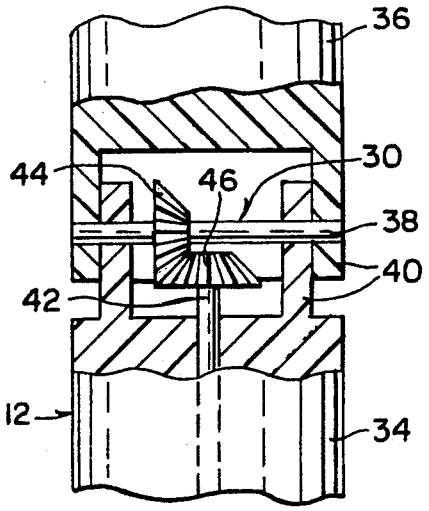
FIG. 4 is a cross sectional view taken along line 4—4 in FIG. 3, showing the bevel gear system to operate the angularly adjustable elongated handle.
Figure 5:
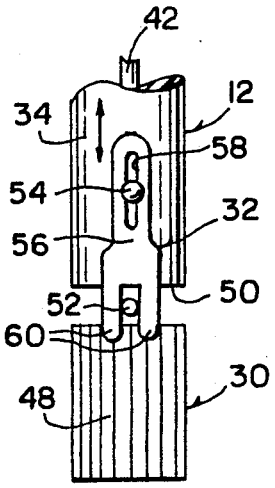
FIG. 5 is an elevational view taken in direction of arrow 5 in FIG. 3, showing the slide lock member in greater detail.

FIGS. 3, 4 and 5 show a structure 30 for angularly adjusting to elongated handle 12 and another structure 32 for locking the elongated handle 12 in an angularly adjusted position so that the user can reach an out of the way place with the air vent lever to be opened and closed.

The sructure 30 includes the elongated handle 12 divided into two segments 34 and 36. A pivot shaft 38 extends through at the junction 40 of the two segments 34 and 36 of the elongated handle 12. A drive shaft 42 rotatably extends through the lower segment 34 of the elongated handle 12. A first bevel gear 44 is affixed to the pivot shaft 38 while a second bevel gear 46 is affixed to inner end of the drive shaft 42 extending outwardly from the bottom 50 of the lower segement 34 of the elongated handle 12. When the control knob 48 is turned the second bevel gear 46 will turn the first bevel gear 44 placing the two segments 34 and 36 of the elongated handle 12 into various angular positions.

The structure 32 includes a pin 52 transversely extending from the drive shaft 42 between the control knob 48 and the bottom 50 of the lower segment 34 of the elongated handle 12. A rivet 54 is mounted to the lower segment 34 of the elongated handle 12 near the bottom 50 thereof. A slide member 56 is provided having a slot 58 at one end and a fork 60 at other end. The slot 58 rides on the rivet 54 so that the fork 60 can engage with the free end of the pin 52 to prevent the drive shaft 42 from rotating thus lockng it in position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An extension device for opening and closing an air vent lever, said extension device comprising:

(a) an elongated handle to be grasped at one end thereof by a user of said extension device;

(b) an enlarged head at other end of said elongated handle, whereby said enlarged head having an enlarged aperture therethrough transversely positioned to said elongated handle;

(c) means within said enlarged aperture of said enlarged head, for opening and closing the air vent lever; wherein said opening and closing means includes said enlarged head further having a pair of slots in which one of said slots is formed extending from an upper portion of said enlarged aperture, while other of said slots is formed extending from a lower portion of said enlarged aperture so that one of each of said slots can push and pull the air vent lever to open and close an air vent depending how the air vent lever is positioned on the air vent; further including the upper portion of said enlarged head being angularly positioned with respect to said elongated handle so that said upper slot will be in a better position to push and pull the air vent lever.

2. An extension device as recited in claim 1, further including:

(a) means for angularly adjusting said elongated handle; and (b) means for locking said elongated handle in an angularly adjusted position so that the user can reach an out of the way place with the air vent lever to be opened and closed.

3. An extension device as recited in claim 2, wherein said angularly adjusting means includes:

(a) said elongated handle divided into two segments;

(b) a pivot shaft extending through at the junction of said two segments of said elongated handle;

(c) a drive shaft rotatbly extending through said lower segment of said elongated handle;

(d) a first bevel gear affixed to said pivot shaft;

(e) a second bevel gear affixed to inner end of said drive shaft and engagable with said first bevel gear; and (f) a control knob affixed to the lower end of said drive shaft extending outwardly from the bottom of said lower segement of said elongated handle so that when said control knob is turned said second bevel gear will turn said first bevel gear placing said two segments of said elongated handle into various angular positions.

4. An extension device as recited in claim 3, wherein said locking means includes:

(a) a pin transversely extending from said drive shaft between said control knob and the bottom of said lower segment of said elongated handle;

(b) a rivet mounted to said lower segment of said elongated handle near the bottom thereof;

(c) a slide member having a slot at one end and a fork at other end whereby said slot rides on said rivet so that said fork can engage with the free end of said pin to prevent said drive shaft from rotating thus locking it in position.

* * * * *